US006763772B2

(12) United States Patent
Gnedenko et al.

(10) Patent No.: US 6,763,772 B2
(45) Date of Patent: Jul. 20, 2004

(54) APPARATUS FOR PROCESSING WASTE

(75) Inventors: Valeri Gnedenko, Moscow (RU); Alexandre Souris, Moscow (RU); David Pegaz, Netanya (IL)

(73) Assignee: E.E.R. Environmental Energy Resources (Israel) Ltd., Ramat Gan (IL)

( * ) Notice: Subject to any disclaimer, the term of this patent is extended or adjusted under 35 U.S.C. 154(b) by 0 days.

(21) Appl. No.: 10/296,819

(22) PCT Filed: May 22, 2001

(86) PCT No.: PCT/IL01/00466

§ 371 (c)(1),
(2), (4) Date: May 5, 2003

(87) PCT Pub. No.: WO01/92784

PCT Pub. Date: Dec. 6, 2001

(65) Prior Publication Data

US 2003/0167983 A1 Sep. 11, 2003

(30) Foreign Application Priority Data

May 29, 2000 (IL) ..... 136431

(51) Int. Cl.[7] ..... F23G 7/04; F23G 5/10
(52) U.S. Cl. ..... 110/238; 110/250
(58) Field of Search ..... 110/250, 238, 110/235, 229, 346

(56) References Cited

U.S. PATENT DOCUMENTS 4,194,454 A * 3/1980 Lalanne et al. ..... 110/238
4,886,001 A 12/1989 Chang et al.
4,989,522 A 2/1991 Cline et al.
5,143,000 A 9/1992 Camacho
5,363,781 A 11/1994 Chang et al.
5,478,440 A * 12/1995 Paju ..... 162/30.1
5,637,127 A 6/1997 McLaughlin et al.
5,809,911 A 9/1998 Feizollahi
5,886,316 A * 3/1999 Pierce ..... 219/121.59
6,202,577 B1 * 3/2001 Boguslavsky et al. ..... 110/346
6,250,236 B1 * 6/2001 Feizollahi ..... 110/346

FOREIGN PATENT DOCUMENTS

| | | |
|---|---|---|
| DE | 38 39 381 A1 | 1/1990 |
| EP | 0 290 815 A1 | 11/1988 |
| EP | 0 845 635 A2 | 6/1998 |
| GB | 1 484 188 | 9/1977 |
| JP | 55-146313 | 11/1980 |

* cited by examiner

*Primary Examiner*—K. B. Rinehart
(74) *Attorney, Agent, or Firm*—Browdy and Neimark, P.L.L.C.

(57) ABSTRACT

A liquid waste feeding system having a liquid inlet to a plasma torch based waste processing chamber, disposed intermediate the primary plasma torch arrangement at the bottom end of the chamber and the top gas products outlet. the liquid inlet is positioned within the chamber such that liquid waste flowing from the inlet into the chamber is directed at a high temperature zone of waste column, and the liquid inlet is typically associated with a hot gas jet means. The hot gas jet means that provides the required high temperature zone may comprise one or more secondary plasma torches configured to provide hot gas jets into the liquid discharge zone of the inlet. Alternatively, the hot gas jet may be provided by the primary plasma torches, in which case the liquid inlet is disposed within a predetermined area close to and above at least one of the primary plasma torches.

20 Claims, 4 Drawing Sheets

APPARATUS FOR PROCESSING WASTE

TECHNICAL FIELD

The present invention relates to an apparatus for processing waste. In particular, the present invention is directed to an apparatus adapted for processing liquid waste in a plasma torch based waste processing plant.

BACKGROUND

The processing of waste including municipal waste, medical waste, toxic and radioactive waste by means of plasma-torch based waste processing plants is well known. Referring to FIG. 1, a typical prior art plasma-based processing plant (1) comprises a processing chamber (10) typically in the form of a vertical shaft, in which solid or mixed (i.e., solid plus liquid and/or semiliquid and/or gaseous) waste (20) is introduced at the upper end thereof via a air lock arrangement (30). One or a plurality of plasma torches (40) at the lower end of the chamber (10) heats the column (35) of waste in the chamber (10), converting the waste into gases that are channeled off via outlet (50), and a liquid material (38) (typically molten metals and/or slag) which is periodically collected at the lower end of the chamber (10) via reservoir (60). Oxidising fluid, such as air, oxygen or steam (70) may be provided at the lower end of the chamber (10) to convert carbon, produced in the processing of organic waste, into useful gases such as CO and $H_2$, for example. A similar arrangement for dealing with solid waste is described in U.S. Pat No. 5,143,000, the contents of which are incorporated herein by reference thereto.

While suitable for dealing with solid waste, this type of processing plant is generally unsuitable for dealing with liquid waste, in particular liquid organic waste and other liquid waste which are volatile in the lower to mid temperature range, i.e., between less than 100° C. to about 500° C. Such liquid waste, when fed to the chamber (10) via the upper air lock arrangement (30) tends to be vaporised well before reaching the lower, high-temperature portions of the chamber (10). Thus, such liquid waste is converted to gaseous waste which subsequently is channeled off, substantially unchanged chemically, via gas output (50), rather than processed and converted by the plasma torches (40). Accordingly, such liquid waste still needs to be further processed downstream in specialised incinerators or other processing facilities.

Furthermore, even when dealing with solid waste, particulate matter and also pitch tend to be entrained with product gases produced in the high temperature conversion process, and are removed from the chamber (10) via gas outlet (50). Such particulate matter may include other organic matter which is removed from the chamber (10) before it has been fully converted by the hot gases generated by the plasma torches. While a scrubber system may be used, in particular a wet scrubbing system, for cleaning the product gases, the particulate matter and the pitch nevertheless need to be further treated.

A number of devices have been proposed for dealing with liquid-type waste. For example, in U.S. Pat. No. 4,989,522, mixed waste is separated into solid waste and liquid waste, the latter being fed to the converting chamber via a separate inlet at the top of the chamber, leading to similar problems of vaporisation, as described above.

In U.S. Pat. No. 5,809,911, a complex multi-zone waste processing system includes a feed subsystem for providing liquid waste to a first reactor. The feed subsystem is located below the plasma torch, and thus the liquid waste is entrained with the plasma jet towards the bed of molten slag material that collects at the bottom of the chamber. The great disadvantage of this arrangement is that the liquid waste effectively cools the slag, leading to crystatisation and partial solidification of the same, which causes complications in removing the solid conversion products from the chamber.

In U.S. Pat. No. 5,637,127, a method for dealing with liquid waste or finely divided solid waste includes mixing the waste with finely divided glassformers and injected directly into a melting duct or tuyere, where it is mixed with the plume of a non-transferred plasma torch prior to being introduced into the chamber proper. The waste-transformer mixture is converted into a fully vitrified glass product, which may be collected from the bottom of the chamber. Thus, this system cannot deal also with regular solid waste, and in any case the liquid waste needs to be preprocessed with the glassformers. Furthermore, the system is designed particularly for inorganic waste, and is not as suitable for dealing with organic liquid waste, in which the conversion process results in gaseous rather than vitrified products.

In U.S. Pat. No. 4,886,001, waste is mixed with water/methanol solvent, and the mixture is injected into a manifold concentric with a plasma torch, and mixed with air prior to encountering the plume of the plasma torch. The addition of water to the waste increases the feed throughput rate of the apparatus, as compared with prior systems which use an expensive MEK/methanol mixture rather than water/methanol. Thus, this system is not suitable for dealing also with solid waste directly, and the preprocessing of the waste with water/methanol results in added complexity and costs.

In U.S. Pat. No. 5,363,781, a device for treatment of liquid and gas waste is described, in which a plasma torch comprises integral tubes or the like for transporting the waste directly to the plasma plume via nozzles disposed at the ends of the tubes. The device is directed to small-scale waste disposal operations, and cannot also deal with solid waste.

Furthermore, none of the above patents, the contents of which are incorporated herein by reference thereto, disclose nor suggest how to deal with particulate matter or pitch entrained by the gasses produced in a regular plasma torch based waste conversion chamber and channeled away therefrom.

It is therefore an aim of the present invention to provide a device and method for dealing with liquid waste which overcomes the limitations of prior art devices and methods.

It is another aim of the present invention to provide such a device that may be incorporated into a solid waste processing apparatus.

It is another aim of the present invention to provide a device for processing liquid waste directly in a plasma-torch type processing apparatus.

It is another aim of the present invention to provide such a device that may also be used for treating particulate matter and pitch previously removed from the plasma torch based processing apparatus.

It is another aim of the present invention to provide such a device that is relatively simple mechanically and thus economic to produce as well as to maintain.

It is another aim of the present invention to provide such a device that incorporates a liquid feed system for feeding liquid waste directly into such an apparatus without the need for preprocessing the waste, in particular such preprocessing in which solvents or other materials are added to the waste.

It is another aim of the present invention to provide such a device for processing liquid waste incorporated as an integral part of a plasma-torch based type mixed waste converter.

It is also an aim of the present invention to provide such a device for processing liquid waste that is readily retrofittable with respect to at least some existing plasma-based solid waste and/or mixed waste converters.

The present invention achieves these and other aims by providing a liquid waste feeding system having an inlet to a plasma torch based waste processing chamber, the liquid inlet being disposed intermediate the primary plasma torch arrangement at the bottom end of the chamber and the top of the waste column within the chamber, in particular the gas products outlet. Further, the liquid inlet is disposed within the chamber such that liquid waste flowing from the inlet into the chamber is directed at a high temperature zone of waste column, and the liquid inlet is typically associated with a hot gas jet means. The hot gas jet means that provides the required high temperature zone may comprise one or more secondary plasma torches configured to provide hot gas jets into the liquid discharge zone of the inlet. Alternatively, the hot gas jet may be provided by the primary plasma torches, in which case the liquid inlet is disposed within a predetermined area close to and above at least one of the primary plasma torches.

SUMMARY OF INVENTION

The present invention relates to a device for converting liquid waste within a waste converting apparatus, the waste converting apparatus having a waste converting chamber adapted for accommodating a column of waste, at least one first plasma torch means for generating a hot gas jet at an output end thereof and for directing said jet towards a bottom longitudinal part of the chamber and at least one gas outlet means at an upper longitudinal part of the chamber, said device comprising:

at least one liquid waste inlet for providing liquid communication between said chamber and a supply of liquid waste, said at least one liquid inlet being longitudinally disposed intermediate said output end of said at least one first plasma torch means and said at least one gas outlet means, wherein said liquid inlet is associated with at least one plasma torch means such that during operation of said device liquid waste flowing from the inlet into said chamber is directed at a high temperature zone provided by the at least one plasma torch means that is associated with said at least one liquid inlet.

In a first embodiment, the at least one plasma torch means that is associated with said at least one liquid inlet is at least one of said first plasma torch means. In this embodiment, the at least one liquid inlet is located within a predetermined arc above said at least one first plasma torch means in close proximity thereto. The arc is typically about ±30° from a centerline of said at least one plasma torch means.

In a second embodiment, the at least one plasma torch means that is associated with said at least one liquid inlet comprises a corresponding at least one second plasma torch means. In this embodiment, the at least one liquid inlet and said at least one second plasma torch means may be disposed in a mixing chamber in communication with said chamber. Alternatively, the at least one liquid inlet and said one second plasma torch means are located within said chamber, wherein said at least one liquid inlet and said at least one plasma torch means are preferably coplanar, the plane containing said at least one liquid inlet and said at least one second plasma torch means being preferably substantially perpendicular to a longitudinal axis of said chamber.

The present invention is also directed to an apparatus for converting waste comprising:

a waste converting chamber adapted for accommodating a column of waste;

at least one first plasma torch means for generating a hot gas jet at an output end thereof and for directing said jet towards a bottom longitudinal part of the chamber;

at least one gas outlet means at an upper longitudinal part of the chamber, said device fisher comprising a device for converting liquid waste, said device comprising:

at least one liquid waste inlet for providing liquid communication between said chamber and a supply of liquid waste, said at least one liquid inlet being longitudinally disposed intermediate said at least one first plasma torch means and said at least one gas outlet means, wherein said liquid inlet is associated with at least one plasma torch means such that during operation of said device liquid waste flowing from the inlet into said chamber is directed at a high temperature zone provided by the at least one plasma torch means that is associated with said at least one liquid inlet.

In the first embodiment, the at least one plasma torch means that is associated with said at least one liquid inlet is at least one of said first plasma torch means, and the at least one liquid inlet is located within a predetermined arc above said at least one first plasma torch means in close proximity thereto. Typically, the arc is about ±30° from a centerline of said at least one plasma torch means.

In a second embodiment, the at least one plasma torch means that is associated with said at least one liquid inlet comprises a corresponding at least one second plasma torch means. In this embodiment, the at least one liquid inlet and said at least one second plasma torch means may be disposed in a mixing chamber in communication with said chamber. Alternatively, the at least one liquid inlet and said one second plasma torch means are located within said chamber, and the at least one liquid inlet and said at least one plasma torch means may be coplanar, wherein the plane of containing said at least one liquid inlet and said at least one second plasma torch means is preferably substantially perpendicular to a longitudinal axis of said chamber.

The apparatus optionally further comprises waste input means associated with said upper part of said chamber. The waste input means may comprise an air lock means comprising a loading chamber for isolating a predetermined quantity of said waste sequentially from an inside of said chamber and from an outside of said chamber. Optionally, the waste input means further comprises suitable disinfecting means for selectively delivering a quantity of suitable disinfectant to at least an outer portion of said air lock means.

The apparatus optionally further comprises a suitable collection means for collecting molten products during operation of said apparatus. The apparatus may comprise at least one outlet port for delivering molten products from said collection means to an outside of said apparatus.

The at least one gas outlet means may be operatively connected to a scrubber means for removing at least one of particulate matter, liquid matter or unwanted gases entrained with product gas stream leaving said chamber via said at least one gas outlet means. Optionally, the scrubber means comprises a reservoir means for collecting at least one of said particulate matter or liquid matter removed by said scrubber. The reservoir means may be operatively connected to said at least one liquid waste inlet means for redirecting any one of said particulate matter of liquid matter in said reservoir means to said chamber.

The apparatus may be adapted for accommodating solid waste and/or liquid waste in said chamber. The liquid waste may comprise at least one of volatile liquid waste or organic liquid waste.

DISCLOSURE OF INVENTION

The present invention is defined by the claims, the contents of which are to be read as included within the disclosure of the specification, and will now be described by way of example with reference to the accompanying Figures.

The present invention relates to a liquid waste processing device for a plasma torch based waste processing apparatus. Such a liquid waste processing device, for converting liquid waste within a plasma torch based waste converting apparatus, is for use with a waste converting apparatus having a waste converting chamber adapted for accommodating a column of waste (which may include solid waste), at least one first plasma torch means for generating a hot gas jet at an output end thereof and for directing said jet towards a bottom longitudinal part of the chamber and at least one gas outlet means at an upper longitudinal part of the chamber. In its simplest form, the liquid waste processing device comprises:

at least one liquid waste inlet for providing liquid communication between said chamber and a supply of liquid waste, said at least one liquid inlet being longitudinally disposed intermediate said output end of said at least one first plasma torch means and said at least one gas outlet means, wherein said liquid inlet is associated with at least one plasma torch means such that during operation of said device liquid waste flowing from the inlet into said chamber is directed at a high temperature zone provided by the at least one plasma torch means that is associated with said at least one liquid inlet.

Figure 1:
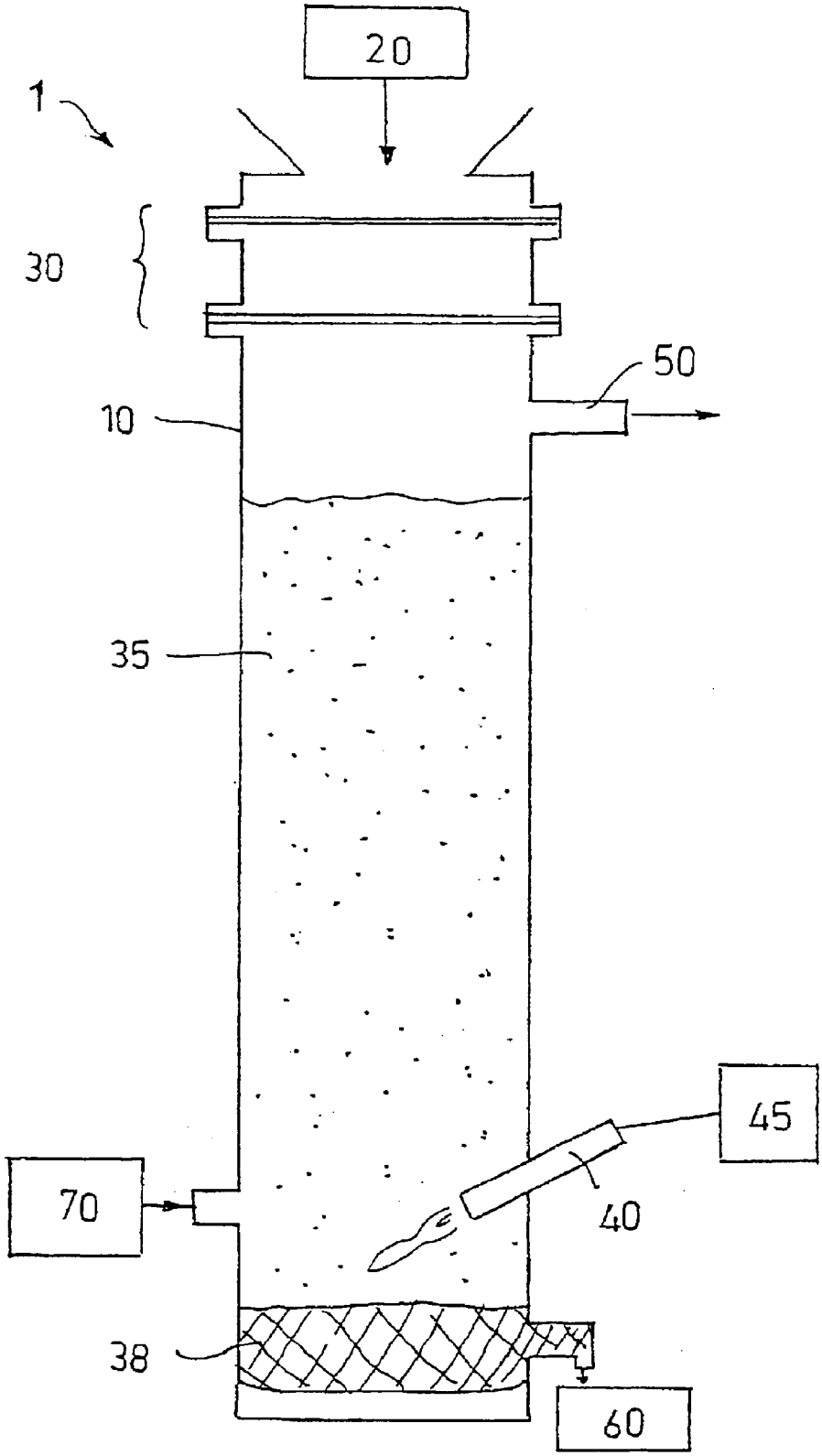
Fig. 1 (PRIOR ART)
FIG. 1 shows schematically the general layout and main elements of a typical solid/mixed waste plasma processing apparatus of the prior art.
Figure 2:
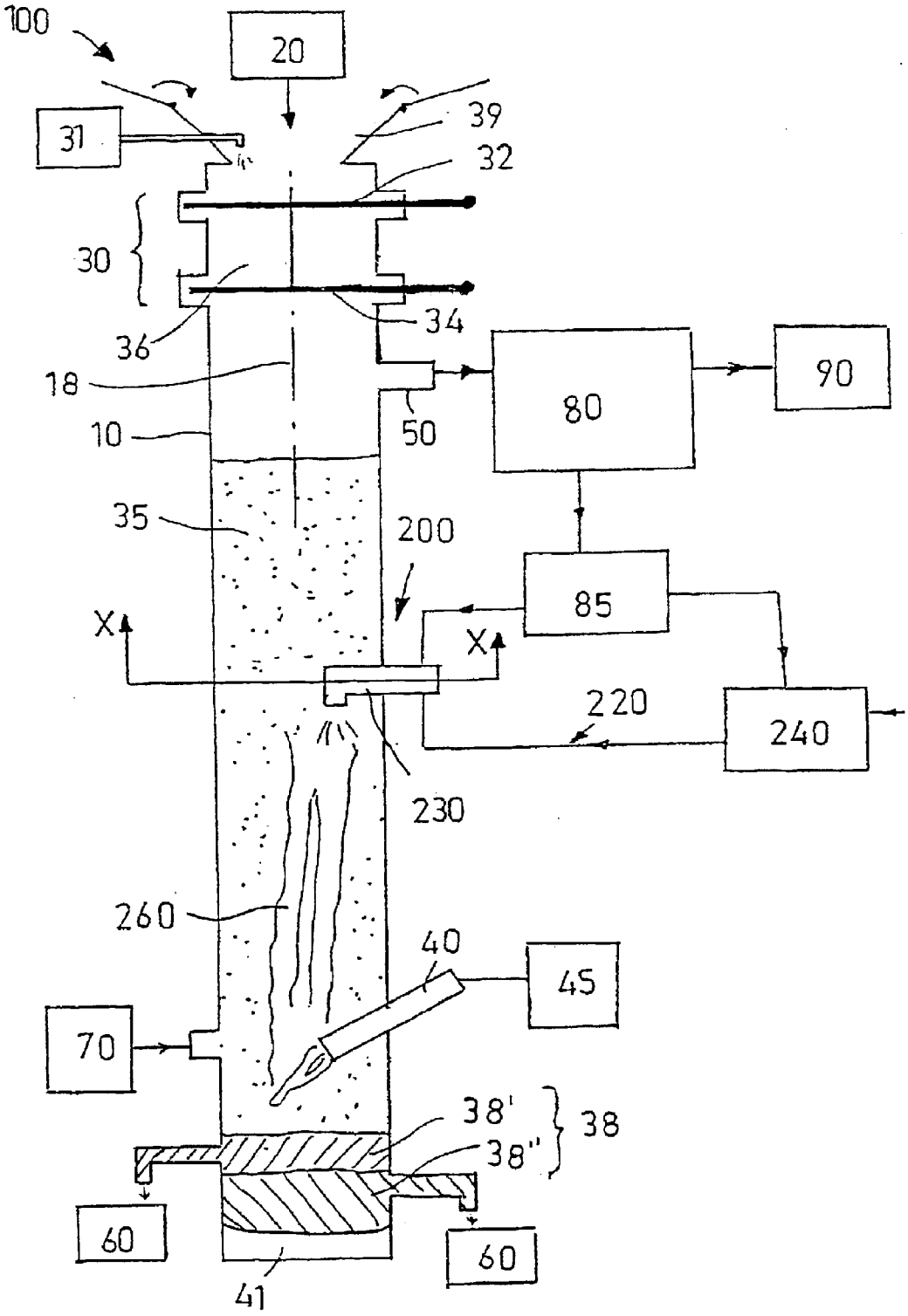
FIG. 2 shows schematically the main elements of a first embodiment of the present in relation to a typical solid/mixed plasma processing apparatus.
Figure 4:
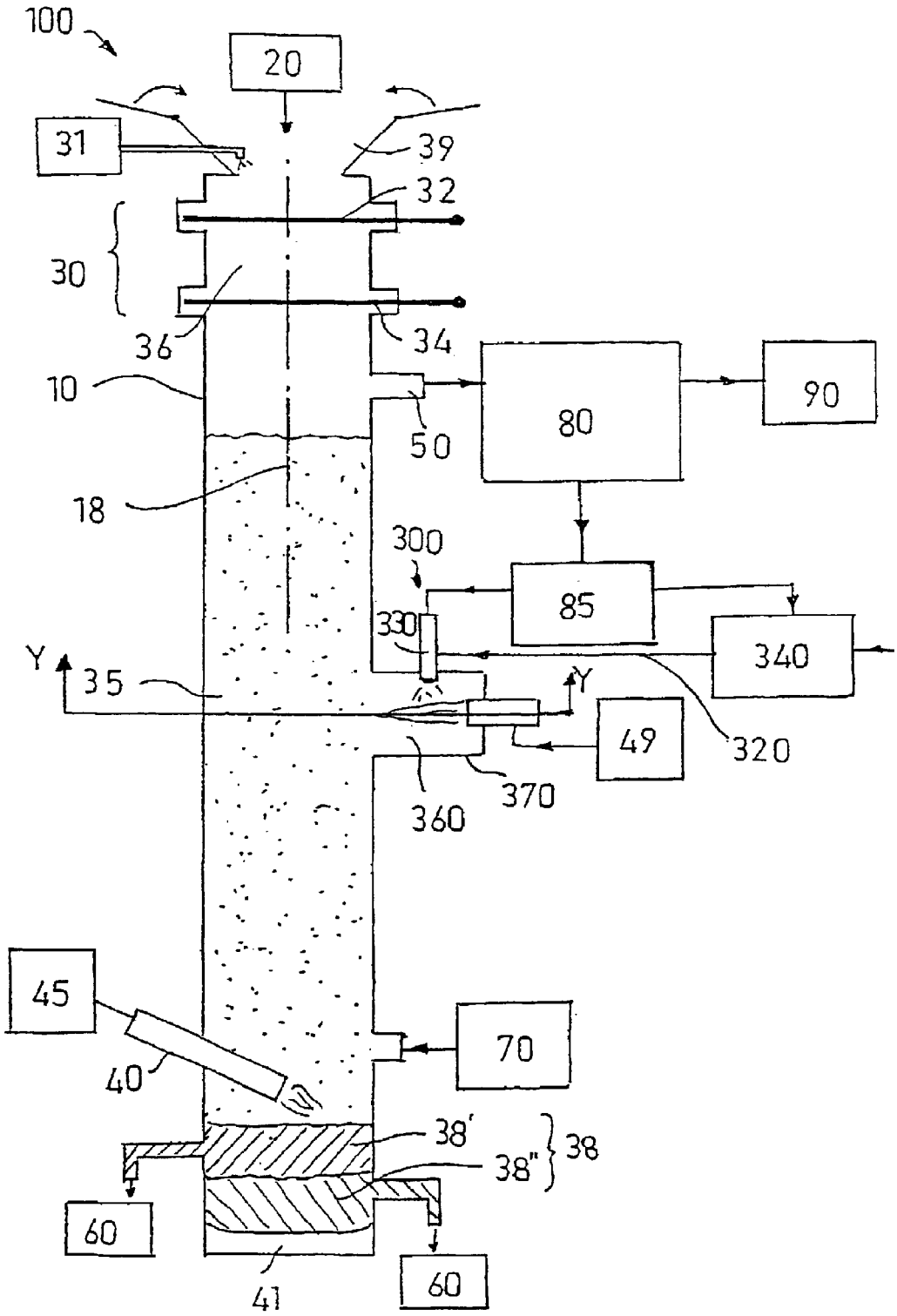
FIG. 4 shows schematically the main elements of a second embodiment of the present in relation to a typical solid/mixed plasma processing apparatus.

Referring to the Figures, FIGS. 2 and 4 respectively illustrate a first and a second embodiment of the present invention. The plasma waste processing apparatus, designated by the numeral (100), comprises a processing chamber (10) typically in the form of a vertical shaft, in which solid or mixed waste feeding system (20) introduces solid/mixed waste at the upper end thereof via a air lock arrangement (30). The solid/mixed waste feeding system (20) may comprise any suitable conveyor means or the like, and may further comprise a shredder for breaking up the waste into smaller pieces. The air lock arrangement (30) may comprise an upper valve (32) and a lower valve (34) defining a loading chamber (36) therebetween. The valves (32), (34) are preferably gate valves operated electrically or hydraulically to open and close independently as required. A closeable hop arrangement (39) funnels typically solid and/or mixed waste from the feeding system (20) into the loading chamber (36) when the upper valve (32) is open, and the lower valve (34) is in the closed position. Feeding of waste into the loading chamber (36) typically continues until the level of waste in the loading chamber (36) reaches a predetermined point below full capacity, to minimise the possibility of any waste interfering with closure of the upper valve (32). The upper valve (32) is then closed. In the closed position, each of the valves (32), (34) provides an air seal. When required, the lower valve (34) is then opened enabling the substantially air-free waste to be fed into the processing chamber (10) The opening and closing of the valves (32), (34), and the feeding of waste from the feeder (20) may be manually controlled and/or computer controlled, and may include suitable sensors for sensing the level of waste in the loading chamber (36) as well as in the processing chamber (10). Optionally, the hop arrangement (39) may comprise a disinfectant spraying system (31) for periodically or continuously spraying the same with disinfectant, as required, particularly when medical waste is being processed by apparatus (100).

The processing chamber (10) is typically, but not necessarily, in the form of a cylindrical shaft having a substantially vertical longitudinal axis (18). The processing chamber (10) is typically made from suitable refractory material, and has a bottom end comprising a liquid product collection zone (41), typically in the form of a crucible, having at least one outlet associated with one or more collection reservoirs (60). The processing chamber (10) further comprises at the upper end thereof at least one primary gas outlet (50) for collecting primarily product gases from the processing of waste. The upper end of the processing chamber (10) comprises the said air lock arrangement (30), and the processing chamber (10) is typically filled with waste material via the airlock arrangement (30) up to about the level of the primary gas outlet (50). A level sensor detects when the level of waste drops sufficiently (as a result of processing in the chamber (10)) to enable another batch of waste to be fed to the processing chamber (10) via the loading chamber (36).

One or a plurality of plasma torches (40) at the lower end of the processing chamber (10) are operatively connected to suitable electric power, gas and water coolant sources (45), and the plasma torches (40) may be of the transfer or non-transfer types. The torches (40) are mounted in the chamber (10) by means of suitably sealed sleeves, which facilitates replacing or servicing of the torches (40). The torches (40) generate hot gases that are directed downwardly at an angle into the bottom end of the column of waste. The torches (40) are distributed at the bottom end of the chamber (10) such that in operation, the plumes from the torches (40) heat the bottom of the column of waste, as homogeneously as possible, to a high temperature, typically in the order of about 1600° C. or more. The torches (40) generate at their downstream output ends hot gas jets, or plasma plumes, having an average temperature of about 2000° C. to about 7000° C. The heat emanating from the torches (40) ascends through the column of waste, and thus a temperature gradient is set up in the processing chamber (10). Hot gases generated by, the plasma torches (40) support the temperature level in the chamber (10) which is sufficient for continuously converting the waste into product gases that are channeled off via outlet (50), and into a liquid material (38) that may include molten metal (38") and/or slag (38'), which may periodically or continuously collected at the lower end of the chamber (10) via one or more reservoirs (60).

Oxidising fluid (70), such as air, oxygen or steam may be provided at the lower end of the chamber (10) to convert carbon, produced in the processing of organic waste, into useful gases such as CO and $H_2$, for example.

The apparatus (100) may further comprise a scrubber system (80) operatively connected to the outlet (50), for removing particulate matter and/or other liquid droplets (including pitch), as well as any undesired gases (such as HCl, $H_2S$, HF, for example) from the product gas stream leaving the chamber (10) via outlet (50). Particulate matter may include organic and inorganic components. Pitch may be contained in the gas stream leaving outlet (50) in gas or liquid form. Scrubbers capable of performing such tasks are well known in the art and do not require to be further elaborated upon herein. The scrubber (80) is operatively connected downstream thereof to a suitable gas processing means (90) such as a gas turbine power plant or a manufacturing plant, for example, for economically utilising the cleaned product gases, typically comprising at this stage $H_2$, CO, $CH_4$, $CO_2$ and $N_2$. The scrubber (80) further comprises a reservoir (85) for collecting particulate matter, pitch and liquid matter removed form the gas products by the scrubber. Such particulate matter and liquid matter (including pitch) require further processing, as will be described herein below.

Figure 3:
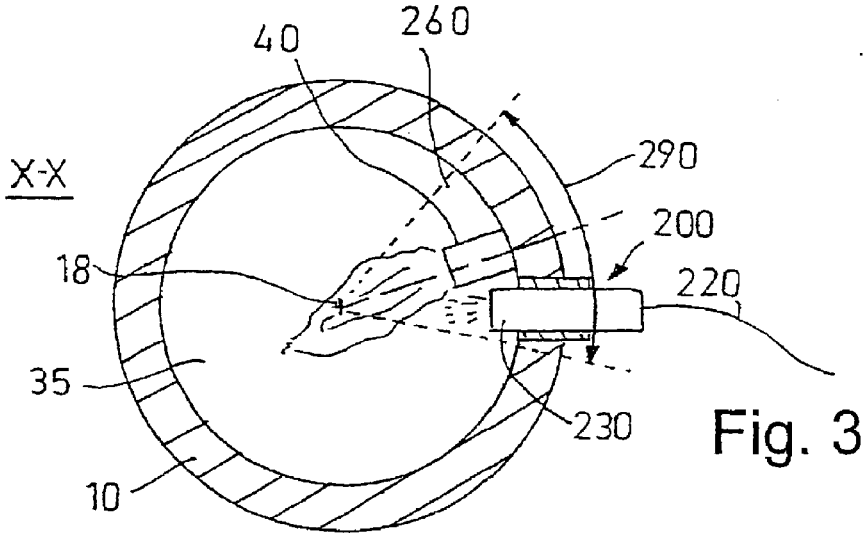
FIG. 3 shows a cross-section of the embodiment of FIG. 2 taken along X—X.

Referring to FIGS. 2 and 3, in the first embodiment of the present invention, the device for processing liquid waste, generally designated at (200), comprises a liquid feed system (220) having at least one inlet (230) to the processing chamber (10) operatively connected to a liquid waste reservoir (240) via suitable pump means (not shown). The liquid feed system (220) may comprise a plurality of reservoirs (240), each independently providing liquid waste to the chamber (10) via one or more inlets (230) associated with each reservoir (240). Multiple reservoirs (240) may be required, for example, when dealing with a range of liquid waste, including some liquids which may be explosive when brought together, and are thus are fed separately (and possibly at different times) to the chamber (10). The position of the inlet (230) within the processing chamber (10) is an important parameter, and injection of liquid waste into the chamber must be avoided at locations between the output end of the plasma torches (40) and the liquid material (38) at the bottom of the chamber, and at the upper end of the chamber (10) in which the temperatures are not sufficient to process the waste into product gases but only serve to vaporise the liquid waste. Rather, the liquid waste inlet (230) is positioned longitudinally intermediate the plasma torches (40) and the top end of the waste column (35), preferably close to at least the output ends of the plasma torches (40). In particular, the liquid waste inlet (230) is disposed within the chamber (10) such that liquid waste flowing from the inlet (230) into the chamber (10) is directed at a high temperature zone (260) of waste column (35), and the liquid waste inlet (230) is typically associated with a plasma torch means. The high temperature zone (260) comprises a sufficiently high temperature for converting the liquid waste, in particular organic and volatile liquid waste, directly into product gases before any vaporisation can take place. In this embodiment, the plasma torch means that provides the required high temperature zone for processing the liquid waste may consist of the primary plasma torches (40), in which case the liquid inlet (230) is disposed within a predetermined area close to and above at least one of the primary plasma torches (40). Preferably, and referring to FIGS. 2 and 3, the liquid waste inlet (230) is disposed above a plasma torch (40), within a predetermined arc (290) taken on a plane perpendicular to the axis (18). The arc (290) provides a measure of the minimum acceptable decay in temperature profile from the plasma torch (40) at the height of the location of the liquid waste inlet (230) such as to provide sufficiently high temperature to process the liquid waste. Typically, said predetermined arc is about ±30° from a centerline of said at least one plasma torch (40). Of course, if the liquid inlet (230) is located too high above the plasma torch (40), or beyond arc (290), the temperature of the zone into which the liquid waste is fed into the chamber (10) may not be sufficient for the liquid waste to be fully converted, and is instead vaporised or partially vaporised and removed from the chamber (10) via outlet (50). If there are a plurality of liquid waste inlets (230), each one thereof should be directed towards a high temperature zone provided by the same, or alternatively different, primary plasma torches (40).

In this embodiment, liquid and particulate matter collected in reservoir (85) from scrubber (80) is re-channeled into the chamber (10) via a shared or alternatively separate liquid waste inlet (230). To assist the feeding of particulate matter, a suitable liquid may be provided to the reservoir (85) to act as a carrier.

Referring to FIG. 4, in the second embodiment of the present invention, the device for processing liquid waste, generally designated at (300), comprises a liquid feed system (320) having at least one inlet (330) to the processing chamber operatively connected to at least one liquid waste reservoir (340) via suitable pump means (not shown). As with the first embodiment, the liquid feed system (320) may comprise a plurality of reservoirs (340), each independently providing liquid waste to the chamber (10) via one or more inlets (330) associated with each reservoir (340). As before, multiple reservoirs may be required, for example, when dealing with a range of liquid waste, including some liquids which may be explosive when brought together, and are thus are fed separately (and possibly at different times) to the chamber (10). The position of the inlet (330) within the processing chamber (10) is an important parameter, and injection of liquid waste into the chamber must be avoided at locations between the output ends of the plasma torches (40) and the liquid material (38) at the bottom of the chamber (10), and at the upper end of the chamber (10) in which the temperatures are not sufficient to process the liquid waste into product gases but only serve to vaporise the liquid waste. Thus the liquid waste inlet (330) is positioned longitudinally intermediate the plasma torches (40) (in particular the output end thereof) and the top end of the waste column (35) (in particular the gas outlets (50)).

As with the first embodiment, the liquid waste inlet (330) is associated with a plasma torch means in order that liquid waste flowing from the inlet (330) into the chamber (10) is directed at a high temperature zone (360) so that rapid conversion of the liquid waste, in particular organic and volatile liquid waste, directly into product gases before any vaporisation can take place. In this embodiment, the plasma torch means that provides the required high temperature zone (360) for processing the liquid waste may consist of one or more secondary plasma torches (48) configured to provide plasma plumes (i.e., hot gas jets) generated by the torches (40), into the liquid discharge zone of the inlet (330). As with the primary plasma torches (40), the secondary plasma torches (48) are operatively connected to suitable electric power, gas and water coolant sources (49), separate to or comprising the electric power, gas and water coolant sources (45) of the primary plasma torches (40).

Figure 5:
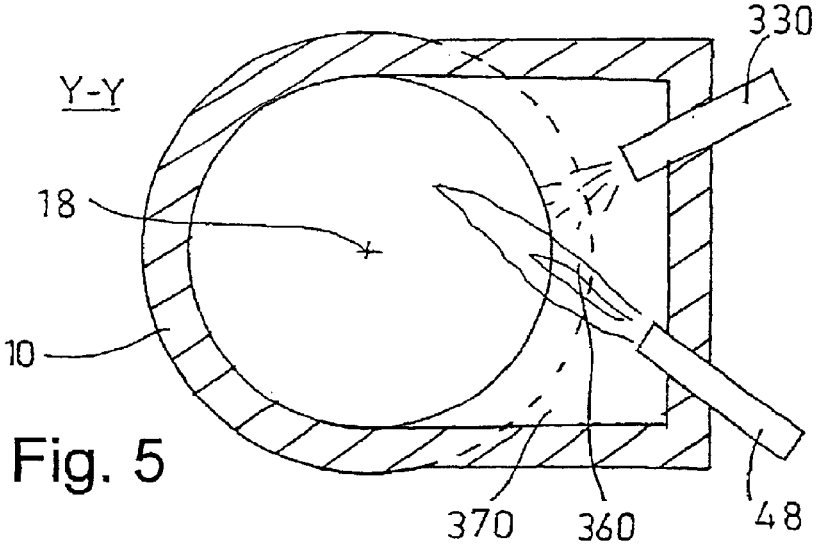
FIG. 5 shows a cross-section of the embodiment of FIG. 4 taken along Y—Y.

As illustrated in FIGS. 4 and 5, the high temperature zone (360) may be at least partially comprised within a mixing chamber (370) laterally extending from the processing chamber (10). This arrangement provides for the mixing of the liquid waste provided via inlet (330) with the hot gas jet or plasma plume provided by the secondary plasma torch (48), enabling the liquid waste to be contained and processed before entering the main waste column (35) in processing chamber (10). Such an arrangement is therefore particularly useful when the device (300) needs to be situated nearer the top of the chamber (10), where the temperature of the waste column (35) is substantially reduced, and in which contact with this part of the waste column (35) could substantially reduce the temperature around the inlet (330) such that at least some of the liquid waste could vaporise rather than be converted by the plasma torch (48).

Figure 6:
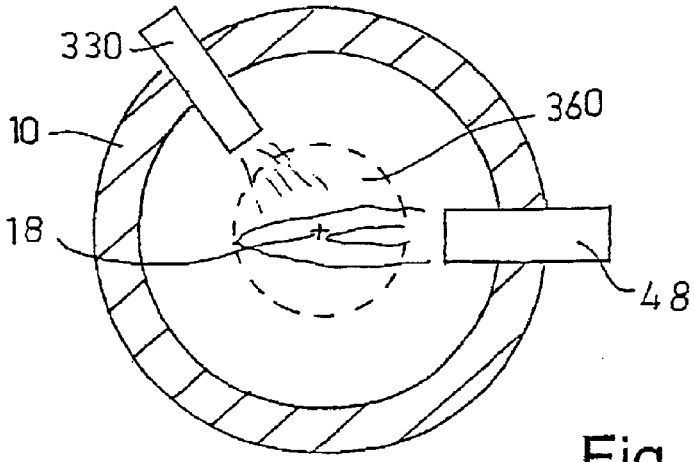
FIG. 6 shows a cross-section of an alternative embodiment to that of FIG. 5.

Other arrangements, however, are also possible. For example, referring to FIG. 6, the secondary plasma torch (48) and the liquid inlet (330) may be positioned within the processing chamber (10) such that the hot gas jet produced by the plasma torch (48) and the liquid waste provided by the inlet (330) are directed and focused towards the same zone (360) within the chamber (10). In this case, the secondary plasma torch (48) and liquid inlet (330) are preferably co-planar, their common plane being perpendicular or at any suitable angle with respect to longitudinal axis (18), and located at any desired location within the chamber (10), intermediate the primary plasma torches (40) and the upper end of the waste column (35). If the chamber (10) comprises a plurality of secondary plasma torches (48) and/or a plurality of liquid inlets (330), any desired numerical combination of these two components may be coupled together to provide one or more high temperature zone (360) serviced by one or more secondary plasma torches (48) and one or more liquid inlets (330), as needed. Of course, any such coupling would need to ensure that, taking consideration of the longitudinal location thereof, the plasma torches (48) provide sufficient energy to maintain the corresponding high temperature zones (360) at a sufficiently high temperature to ensure complete conversion of the liquid waste provided by the corresponding liquid inlets (330).

As with the first embodiment, liquid and particulate matter collected in reservoir (85) from scrubber (80) is re-channeled into the chamber (10) via a shared or separate liquid waste inlet (330). To assist the feeding of particulate matter, a suitable liquid may be provided to the reservoir (85) to act as a carrier.

While the device for processing liquid waste according to the present invention, in particular the first and second embodiments thereof, are best incorporated as an integral part of a plasma-type mixed waste converter, it is clear that the device of the present invention is readily retrofittable on a large number of existing plasma-based solid waste converters, as well as mixed waste converters. Furthermore, it is also clear that the device of the present invention may also be incorporated or indeed retrofitted into a plasma torch based converter dealing with liquid waste only.

While in the foregoing description describes in detail only a few specific embodiments of the invention, it will be understood by those skilled in the art that the invention is not limited thereto and that other variations in form and details may be possible without departing from the scope and spirit of the invention herein disclosed.

What is claimed is:

1. Apparatus for converting waste comprising:

(a) a waste converting chamber adapted for accommodating a column of waste;

(b) at least one first plasma torch means for generating a hot jet at an output end thereof and for directing said jet towards a bottom longitudinal part of the chamber;

(c) at least one gas outlet means at an upper longitudinal part of the chamber, (d) waste input means associated with said upper part of said chamber for introducing solid/mixed waste into said chamber;

and characterized in further comprising:

(e) at least one liquid waste inlet for providing liquid communication between said chamber and a supply of liquid waste, said at least one liquid inlet being longitudinally disposed intermediate said at least one first plasma torch means and said waste input means, wherein said liquid inlet is associated with at least one plasma torch means such that during operation of said device liquid waste flowing from the inlet into said chamber is directed at a high temperature zone provided by the at least one plasma torch means that is associated with said at least one liquid inlet.

2. An apparatus according to claim 1, wherein said at least one plasma torch means that is associated with said at least one liquid inlet comprises a corresponding at least one second plasma torch means.

3. An apparatus according to claim 2, wherein said at least one liquid inlet and said at least one second plasma torch means are disposed in a mixing chamber in communication with said chamber.

4. An apparatus according to claim 2, wherein said at least one liquid inlet and said one second plasma torch means are located within said chamber.

5. An apparatus according to claim 4, wherein said at least one liquid inlet and said at least one plasma torch means are coplanar.

6. An apparatus according to claim 5, wherein a centerline of said second plasma torch means is comprised on a plane substantially perpendicular to a longitudinal axis of said chamber.

7. An apparatus according to claim 1, wherein said at least one plasma torch means that is associated with said at least one liquid inlet is at least one of said first plasma torch means.

8. An apparatus according to claim 7, wherein said at least one liquid inlet is located within a predetermined arc on a plane above said at least one first plasma torch means in close proximity thereto.

9. An apparatus according to claim 8, wherein said arc is about ±30° from a centerline of said at least one plasma torch means.

10. An apparatus as claimed in claim 1, wherein said waste input means comprises an air lock means comprising a loading chamber for isolating a predetermined quantity of said waste sequentially from an inside of said chamber.

11. An apparatus according to claim 10, wherein said waste input means further comprises suitable disinfection means for selectively delivering a quantity of suitable disinfectant to at least an outer portion of said air lock means.

12. An apparatus according to claim 1, further comprising a suitable collection means for collecting molten products during operation of said apparatus.

13. An apparatus according to claim 12, further comprising at least one outlet port for delivering molten products from said collection means to an outside of said apparatus.

14. An apparatus according to claim 1, wherein said at least one gas outlet means is operatively connected to a scrubber means for removing at least one of particulate matter liquid matter or unwanted gases entrained with product gas stream leaving said chamber via said at least one gas outlet means.

15. An apparatus according to claim 14, wherein said scrubber means comprises a reservoir means for collecting at least one of said particulate matter or liquid matter removed by said scrubber.

16. An apparatus according to claim 15, wherein said reservoir means is operatively connected to said at least one liquid waste inlet means for redirecting any one of said particulate matter or said liquid matter in said reservoir means to said chamber.

17. An apparatus according to claim 1, wherein said waste accommodated in said chamber comprises solid waste.

18. An apparatus according to claim 17, wherein said waste to be accommodated in said chamber further comprises liquid waste.

19. An apparatus according to claim 1, wherein said waste accommodated in said chamber comprises liquid waste.

20. An apparatus according to claim 1, wherein said liquid waste comprises at least one of volatile liquid waste or organic liquid waste.

* * * * *